US007841392B1

(12) United States Patent
Short, Jr. et al.

(10) Patent No.: US 7,841,392 B1
(45) Date of Patent: Nov. 30, 2010

(54) METHOD AND APPARATUS FOR CONTROLLING TEMPERATURE GRADIENTS WITHIN A STRUCTURE BEING COOLED

(75) Inventors: Byron Elliott Short, Jr., Fairview, TX (US); Jay M. Ochterbeck, Clemson, SC (US)

(73) Assignee: Raytheon Company, Waltham, MA (US)

( * ) Notice: Subject to any disclaimer, the term of this patent is extended or adjusted under 35 U.S.C. 154(b) by 1178 days.

(21) Appl. No.: 11/423,609

(22) Filed: Jun. 12, 2006

Related U.S. Application Data

(62) Division of application No. 10/693,562, filed on Oct. 24, 2003, now Pat. No. 7,061,446.

(60) Provisional application No. 60/421,373, filed on Oct. 24, 2002.

(51) Int. Cl.
*F28F 7/00* (2006.01)
*H01Q 21/00* (2006.01)

(52) U.S. Cl. ..... 165/139; 343/893

(58) Field of Classification Search ..... 343/853, 343/893; 165/139
See application file for complete search history.

(56) References Cited

U.S. PATENT DOCUMENTS 5,816,313 A 10/1998 Baker ..... 165/41
5,829,519 A 11/1998 Uthe ..... 166/60
5,934,079 A * 8/1999 Han et al. ..... 62/3.2
6,205,803 B1 3/2001 Scaringe ..... 62/259.2
7,061,446 B1 * 6/2006 Short et al. ..... 343/893
7,251,889 B2 * 8/2007 Kroliczek et al. ..... 29/890.07
2005/0061487 A1 3/2005 Kroliczek et al. ..... 165/139

OTHER PUBLICATIONS

U.S. Appl. No. 10/693,562, filed Jun. 12, 2006, entitled "Method and Apparatus for Controlling Temperature Gradients within a Structure Being Cooled", by Bryon Elliott Short, Jr. and Jay M. Ochterbeck, 72 pgs.

* cited by examiner

*Primary Examiner*—Shih-Chao Chen
(74) *Attorney, Agent, or Firm*—Baker Botts L.L.P.

(57) ABSTRACT

A phased array antenna apparatus has a plurality of circuit portions which are each coupled to a respective antenna element. Capillary pressure of a cooling fluid within a wick in a loop is utilized to urge the fluid to travel around the loop, the wick being disposed in the region of the circuitry. In a variation, there are plural wicks in respective evaporators, and cooling fluid is distributed among the evaporators through a series of T-junctions. In another variation, cooling fluid is distributed to a plurality of evaporators in a sequence corresponding to a progressive increase in the respective amounts of heat accepted by the evaporators from structure being cooled.

26 Claims, 3 Drawing Sheets

10
88
HEAT SINK
CONDENSER
CONDENSER
CONDENSER
CONDENSER
CONDENSER
CONDENSER
85
86
84
83
82
81
14
77
91
ANTENNA SYSTEM
50
70
EVAPORATOR
48
49
69
EVAPORATOR
46
47
68
EVAPORATOR
44
45
67
EVAPORATOR
42
43
66
EVAPORATOR
41
65
40
EVAPORATOR
39
38
EVAPORATOR
37
36
64
EVAPORATOR
35
34
63
EVAPORATOR
33
32
62
EVAPORATOR
31
61
VAPOR HEADER
LIQUID RETURN
76
89
12
93
RESERVOIR
94
HEATER
96

METHOD AND APPARATUS FOR CONTROLLING TEMPERATURE GRADIENTS WITHIN A STRUCTURE BEING COOLED

RELATED APPLICATIONS

This application is a divisional of U.S. application Ser. No. 10/693,562, filed Oct. 24, 2003 entitled "Method and Apparatus for Controlling Temperature Gradients Within a Structure Being Cooled," now U.S. Pat. No. 7,061,446.

U.S. application Ser. No. 10/693,562 claims priority under 35 U.S.C. §119 of Provisional Application No. 60/421,373 filed Oct. 24, 2002.

TECHNICAL FIELD OF THE INVENTION

This invention relates in general to cooling techniques and, more particularly, to cooling techniques which facilitate control of temperatures and temperature gradients within a structure being cooled.

BACKGROUND OF THE INVENTION

There are a variety of types of applications in which there is a need to control temperatures and/or temperature gradients within a structure being cooled. One example is phased array antenna systems, which are used in a number of different contexts, such as satellites and other space vehicles. A phased array antenna system includes an array of antenna elements that are separately controlled by respective circuit portions. Wavefronts transmitted and received by the antenna system are represented electrically by respective signals at the various antenna elements, and these electrical signals have phases which typically vary from antenna element to antenna element across the array. Consequently, it is important that the circuit portions associated with respective antenna elements introduce equal amounts of phase delay into the signals passing through them. Variations in the phase characteristics of the different circuit portions are undesirable, because such variations can introduce distortion into transmitted wavefronts and received wavefronts.

The circuit portions used to control the antenna elements in existing phased array antenna systems have phase characteristics that inherently vary with temperature. Consequently, in order to avoid undesirable phase variations between electrical signals in the circuit portions for different antenna elements, it is desirable that all of the circuit portions for all of the antenna elements operate at substantially the same temperature. In other words, it is desirable to avoid any significant temperature gradients across the array.

Various cooling techniques have previously been developed to attempt to avoid temperature gradients across the circuitry of phased array antenna systems. Some approaches utilize a single-phase or two-phase coolant which is mechanically pumped. However, mechanically pumping these coolants requires an external source of energy to drive the pump, and the use of a mechanical pump presents reliability concerns as a result of the possibility of a mechanical failure. The reliability considerations are of particular concern with respect to environments such as a space vehicle, where repairs can be difficult or impossible.

A different approach uses heat pipes. However, since a phased array antenna system typically has a two-dimensional array of antenna elements, heat pipes represent a one-dimensional attempt to solve a two-dimensional problem. In particular, a layer of parallel heat pipes can be provided to transport high heat fluxes in directions parallel to the heat pipes, but it is not possible to distribute heat in a transverse direction without adding a second layer of heat pipes that extends transversely to the first layer. The second layer of heat pipes increases the size and weight of the system, and is not as effective as the first layer in distributing heat, due to the conductive resistance between the two layers of heat pipes. In a phased array antenna system in which the circuitry is provided in a configuration commonly known as a slat architecture, the use of even a single layer of heat pipes may be difficult or impossible, due to dimensional limitations inherent in the system.

SUMMARY OF THE INVENTION

From the foregoing, it may be appreciated that a need has arisen for an improved method and apparatus to effect cooling of a structure where varying temperature gradients are undesirable. The present invention provides a method and apparatus to address this need.

A first form of the invention involves a technique for cooling an apparatus which includes an antenna section with a plurality of antenna elements, and circuitry having a plurality of circuit portions each operatively coupled to a respective one of the antenna elements. Capillary pressure of a cooling fluid within a wick in a loop is utilized to urge the fluid to travel around the loop, the wick being disposed within the loop in the region of the circuitry.

A second form of the invention involves: providing in the region of heat-generating structure a plurality of evaporators which each include a wick; utilizing capillary pressure of the fluid within the wicks to urge the fluid to travel around the loop; distributing fluid flowing through the loop among the evaporators with a manifold section having a plurality of first passageway sections which each have an inlet end and which each have an outlet end coupled to an input of a respective evaporator, and having a plurality of second passageway sections that each have a first end which is approximately normal to and communicates with a respective first passageway section, and that each have a second end which is coupled to the first end of a different first passageway section.

A third form of the invention involves: providing in the region of heat-generating structure a plurality of evaporators which each include a wick; utilizing capillary pressure of the fluid within the wicks to urge the fluid to travel around the loop; distributing fluid flowing through the loop among the evaporators in a sequence corresponding to a progressive increase in the respective amounts of heat accepted by the evaporators from the structure.

BRIEF DESCRIPTION OF THE DRAWINGS

A better understanding of the present invention will be realized from the detailed description which follows, taken in conjunction with the accompanying drawings, in which.

DETAILED DESCRIPTION OF THE INVENTION

Figure 1:
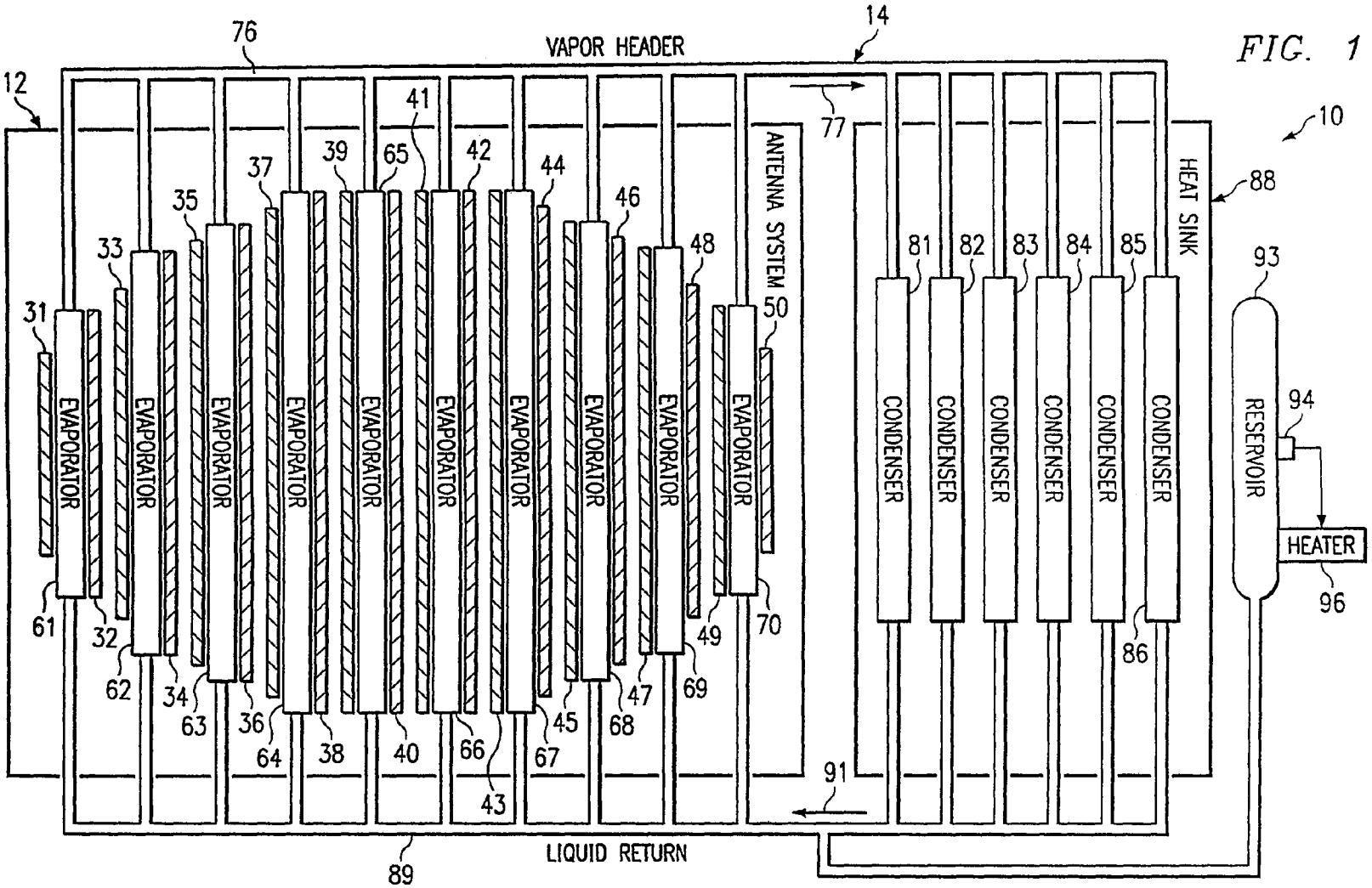
FIG. 1 is a block diagram of an apparatus which includes a phased array antenna system and an associated cooling system, and which involves aspects of the present invention.

FIG. 1 is a block diagram of an apparatus 10 which embodies aspects of the present invention. In the disclosed embodiment, the apparatus 10 is configured for use in a satellite, but the present invention can be used in a wide variety of contexts other than a space vehicle. The apparatus 10 includes a phased array antenna system and a cooling system 14 for the antenna system, at least part of the cooling system 14 being disposed within the antenna system 12.

Figure 2:
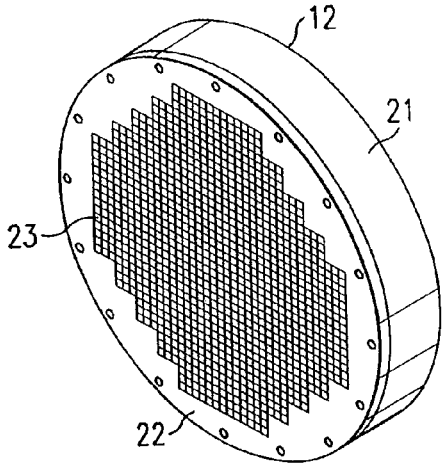
FIG. 2 is a diagrammatic perspective view of the phased array antenna system of FIG. 1.

FIG. 2 is a diagrammatic perspective view of the phased array antenna system 12. The antenna system 12 includes a housing 21 having on one side thereof a planar wall 22, and includes a plurality of antenna elements 23 which are provided on the wall 22. The antenna elements 23 are arranged in an approximately circular array which includes a plurality of parallel columns and a plurality of parallel rows, the rows extending perpendicular to the columns. The antenna system 12 includes circuitry which is not visible in FIG. 2, and which is operatively coupled to each of the antenna elements 23. The circuitry includes a plurality of similar circuit portions, and each circuit portion is operatively coupled to a respective one of the antenna elements 23.

Referring again to FIG. 1, the antenna system 12 includes several slats 31-50. Slats 31-50 extend parallel to each other and perpendicular to the wall 22 of the housing 21. Each of the slats is aligned with a respective row of the antenna elements 23, and includes the circuit portions for each of the antenna elements in that row. For clarity, the number of slats 31-50 depicted in FIG. 1 is somewhat less than the number of rows of antenna elements shown in FIG. 2, but persons skilled in the art will understand that there is in fact a separate slat for each row of antenna elements. The slats 31-50 each have a configuration of a known type, and the circuitry on the slats is of a known type. Consequently, the slats 31-50 are not illustrated and described in further detail.

The cooling system 14 includes a plurality of evaporators 61-70, which are each disposed between a respective pair of two adjacent slats 31-50. Each evaporator 61-70 accepts heat generated by the two adjacent slats, and transfers it to a cooling fluid which is flowing through that evaporator, causing the fluid to change from a liquid state to a vapor state, as discussed in more detail later. The resulting vapor then exits the evaporators 61-70 and enters a vapor header 76, and travels through the vapor header 76 in a direction indicated by an arrow 77.

The cooling system 14 includes a plurality of condensers 81-86, each of which has an inlet coupled to the vapor header 76. The embodiment of FIG. 1 has six condensers 81-86, but the number of condensers could be larger or smaller. The condensers 81-86 are each thermally coupled to a heat sink 88. As mentioned above, the embodiment of FIG. 1 is configured for use in a satellite, and the heat sink 88 has a surface portion which serves as part of the exterior surface of the satellite. The heated vapor from the vapor header 76 enters the condensers 81-86, and the condensers convert the vapor back into a liquid, in particular by transferring heat from the vapor to the heat sink 88. The heat sink 88 then discharges this heat into free space. The liquid exiting the outlets of the condensers 81-86 is then supplied through a liquid return line 89 in the direction of an arrow 91 to inlets of the evaporators 61-70.

The cooling system 14 includes a reservoir 93, which is in fluid communication with the liquid return line 89 at a location between the outlets of condensers 81-86 and the inlets of evaporators 61-70. The reservoir 93 could alternatively communicate with the liquid return line 89 at some other location along the length of the liquid return line 89. A temperature sensor 94 is provided on the reservoir 93, in order to sense the temperature of cooling fluid disposed within the reservoir 93. A heater 96 is controlled by the sensor 94, and can supply heat to the cooling fluid within the reservoir 93, in order to increase the temperature of the cooling fluid.

Figure 3:
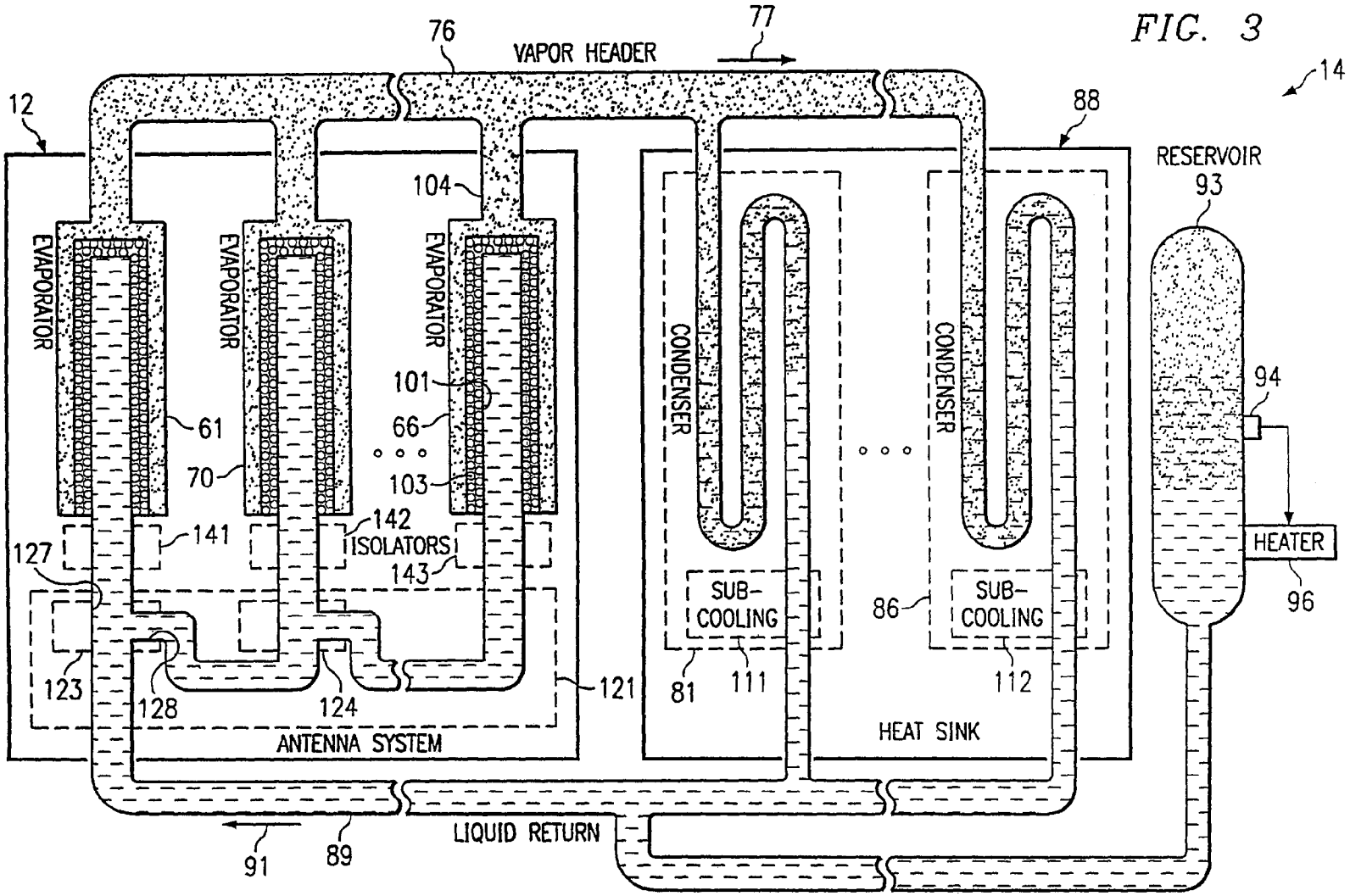
FIG. 3 is a block diagram of the cooling system of FIG. 1, and shows certain features of the system in greater detail.

FIG. 3 is a diagrammatic view of the cooling system 14 of FIG. 1, and shows certain portions of the system in more detail than FIG. 1. In this regard, the evaporators 61-70 are each a device of a known type. As shown in FIG. 3, each evaporator includes an inlet tube 101, which extends into an elongate recess provided within a wick 103 of the evaporator. In the disclosed embodiment, the wick 103 is made from a plurality of thermally conductive balls, which are fixedly coupled together by sintering. However, the wick 103 could alternatively be made from a screen material, a fibrous material, a different sintered material, or some other suitable material. The wick 103 is disposed in a chamber provided within a housing of the evaporator, and the chamber communicates with an outlet 104 of the evaporator.

In the disclosed embodiment, the heat sink 88 is highly efficient, and the liquid exiting each condenser 81-86 is subcooled to a temperature lower than that needed for proper operation of the evaporators 61-70. This subcooling of the liquid coolant is indicated diagrammatically at 111 and 112 in FIG. 3. The sub-cooling of the liquid could alternatively be carried out by some time type of active cooling arrangement, such as a refrigeration system.

The sub-cooled liquid exiting the condensers 81-86 is supplied through the liquid return line 89 to a manifold 121, which facilitates an efficient distribution of the cooling fluid among the evaporators 61-70. The manifold 121 include several T-junctions, two of which are indicated by broken lines at 123 and 124 in FIG. 3. Each T-junction includes a first passageway section 127 which is parallel to and communicates with the inlet tube 101 of a respective evaporator. Each T-junction also includes a second passageway section 128, which extends approximately perpendicular to and communicates at one end with the central portion of the first passageway section 127. The outlet of each passageway section 128 communicates with the inlet of the passageway section 127 of the next successive T-junction in the manifold 121. The only exception is the last evaporator in the sequence.

The manifold 121 is configured to supply fluid to evaporators 61-70 in an order based on the respective amount of heat absorbed by each evaporator under normal operating conditions. In this regard, and with reference to FIG. 1, it will be noted that the outmost evaporators 61-70 cool the smallest slats, which have less circuitry than slats at the center of the antenna array (such as the slat 41). The evaporators 61 and 70 thus absorb less heat than the evaporators at the center of the array, such as the evaporator 66. In some antenna systems, the slats at the center of the array antenna may handle higher-power signals than the outermost slats, and this is a further factor that can cause the slats at the center of the array to generate more heat than the slats near the edges.

The manifold 121 distributes the cooling fluid to the slats in an order corresponding to the amount of heat typically dissipated by each slat, from the slats that dissipate the least heat progressively to the slats that dissipate the most, heat. Thus, the manifold 121 distributes cooling fluid first to the evaporators 61 and for the outermost slats, then to nearby evaporators, and finally to the evaporators in the center of the array, such as the evaporator 66.

An isolator of a known type can optionally be provided at the inlet to each of the evaporators 61-70, as indicated diagrammatically at 141-143 in FIG. 3. The embodiment of FIG. 3 does not actually include the isolators 141-143, and the isolators 141-143 are therefore shown in broken lines in FIG. 3.

The cooling system shown in FIG. 3 is a unique variation of a type of cooling system commonly known as a capillary pumped loop. The cooling system of FIG. 3 operates in the following manner. With reference to the evaporator 66, cooling fluid in a liquid state flows through the inlet tube 101 and enters the material of the wick 103. Heat from the circuitry on the slats 61-70 (FIG. 1) is transferred to the evaporators, including the wick 103 of each evaporator. Liquid coolant in each wick absorbs heat, changes from a liquid to a vapor, and then exits the evaporator through the outlet 104.

As the cooling fluid in the wick changes phase from a liquid to a vapor, there is a vapor pressure increase in the region of this phase change, which causes cooling fluid within the wick to move. This capillary pressure within each wick causes the cooling fluid to travel around the loop shown in FIG. 3, from the evaporators 61-70 through the vapor header 76 to the condensers 81-86, and from the condensers through the liquid return line 89 back to the evaporators. In this regard, in order for the cooling fluid to flow around the loop, the capillary pressure in the wick must be greater than the pressure losses throughout the rest of the loop.

When the vapor in the vapor header 76 reaches the condensers 81-86, the condensers transfer heat from the vapor to the heat sink 88, thereby cooling the vapor sufficiently so that it condenses back into a liquid. The heat sink 88 is somewhat oversized, so as to extract more heat than necessary from the cooling fluid. As result, the cooling fluid exiting the condensers 81-86 is sub-cooled, thereby cold biasing the system. In other words, the cooling fluid leaving the condensers 81-86 and entering the liquid return line 89 has a temperature which is less than the fluid temperature that will cause the evaporators to operate with optimum efficiency.

The cooling fluid in the liquid return line 89 has, of course, a high thermal transport capacity. The heater 96 at the reservoir 93 is used to bring the sub-cooled liquid in the liquid return line 89 up to a suitable temperature for introduction into the evaporators 61-70. In this regard, the reservoir 93 contains a quantity of the cooling fluid, part of which will be in a liquid form and part of which will typically be in vapor form. The temperature sensor 93 senses the temperature of the cooling fluid within the reservoir 93, for example in a central region that typically contains a mixture of the liquid and vapor. The sensor 94 controls the heater 96 in a manner so that the heater 96 supplies heat to the liquid portion of the fluid in the reservoir 93. By maintaining the fluid in the reservoir 93 at a selected temperature which corresponds to optimal operation of the evaporators, the thermal transport capacity of the cooling fluid maintains the cooling within the liquid return line 89 at approximately this same temperature, so that the cooling fluid reaching each evaporator is at the temperature which facilitates optimal operation.

The reservoir 93 also functions to provide cooling liquid inventory for variable operating conditions. More specifically, the phased array antenna system is capable of operating in different modes, and the circuitry on the slats will generate significantly more heat in some operating modes than in other operating modes. Thus, the cooling system 14 must dissipate significantly more heat during some operating modes than during other operating modes, which in turn affects the amount of heat in the cooling fluid and thus the proportion of vapor to liquid throughout the system. The reservoir accommodates these changes in operating conditions by keeping the main cooling loop full of cooling fluid, regardless of variations in the proportion of vapor to liquid.

As fluid from the liquid return line 89 enters the manifold 121, the T-junctions (including those at 123-124) facilitate an appropriate distribution of cooling fluid among the evaporators. In this regard, if the T-junctions were omitted and the cooling fluid was supplied in a uniform and parallel manner to the inlets of all of the evaporators, evaporators absorbing greater amounts of heat would tend to deprive evaporators absorbing smaller amounts of heat of sufficient cooling fluid. Consequently, in this disclosed embodiment, the evaporators which absorb the largest amounts of heat are the last evaporators to receive fluid from the manifold 121, and help to draw fluid through the manifold 121 past the inlets of evaporators that absorb smaller amounts of heat. Further, the T-junctions (including those at 123 and 124) help to direct fluid flow straight into the inlets of the evaporators that absorb smaller amounts of heat, while allowing some of that fluid flow to be drawn off at a right angle to flow to other evaporators that absorb larger amounts of heat.

If the optional isolators are provided, such as those shown at 141-143, each isolator acts to trap any vapor bubbles that may be present in the liquid passing through it, and to hold those bubbles until they condense or collapse back into liquid form.

Figure 4:
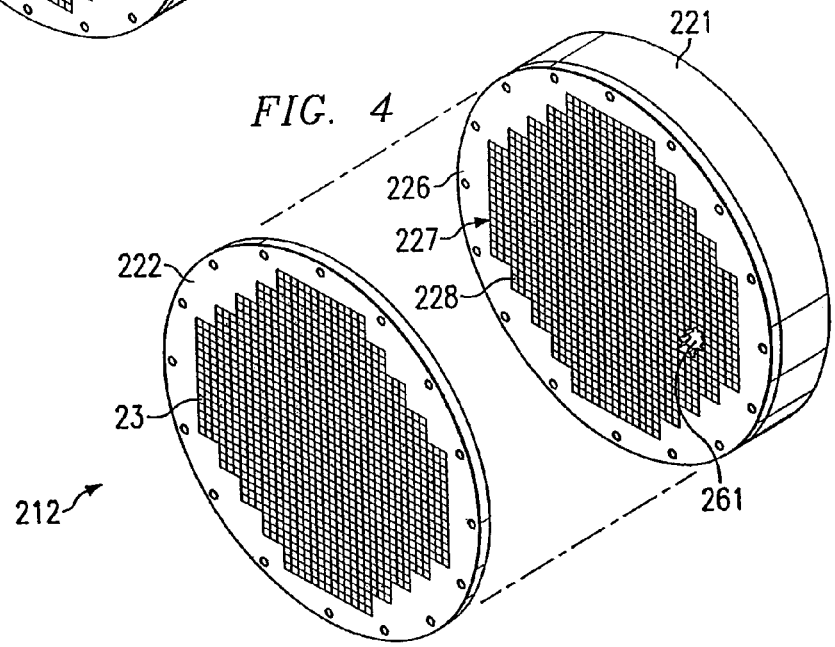
FIG. 4 is a diagrammatic exploded perspective view of a phased array antenna system which is an alternative embodiment of the antenna system of FIG. 2.

FIG. 4 is a diagrammatic exploded perspective view of a phased array antenna system 212 which is an alternative embodiment of the antenna system 12 shown in FIG. 2. The antenna system 212 includes a housing 221 with a wall portion 222 that has thereon an array of antenna elements 23. Behind the wall portion 222 is a circuit board 226 having circuitry which is indicated diagrammatically at 227. The circuitry 227 includes a plurality of circuit portions 228, each of which is disposed adjacent and operatively coupled to a respective antenna element 23. It will be noted that the circuitry 227 of the antenna system 212 does not include slats of the type shown at 31-50 in FIG. 1. Instead, the circuitry 227 for all of the antenna elements is provided entirely on the circuit board 226 that extends parallel to the wall portion 222. The antenna system 212 in FIG. 4 has a configuration of a type known as a "tile" architecture, whereas the antenna system 12 of FIG. 2 has a configuration known as "slat" architecture.

A portion of the circuit board 226 is broken away in FIG. 4, in order to show part of an evaporator 261 which is disposed immediately behind the circuit board 226, and which absorbs heat produced by the circuitry 227. In the embodiment of FIG. 4, there is one evaporator 261 which absorbs heat from all of the circuit portions 228 of the circuitry 227. However, it would alternatively be possible to provide several evaporators behind and adjacent the circuit board 226, in place of the single evaporator 261. The evaporator 261 is part of a cooling system that is generally similar in structure and operation of the cooling system shown in FIG. 3, except that the evaporator 261 is configured to be disposed adjacent to the circuit board 226, rather than between a pair of slats in the manner shown in FIG. 1.

As mentioned above, the cooling system shown in FIG. 3 is a unique variation of a type of cooling system commonly known as a capillary pumped loop (CPL). In place of the CPL cooling system 14 shown in FIG. 3, it would alternatively be possible to use a unique variation of a different type of cooling system commonly known as a loop heat pipe (LHP). In this regard, the LHP cooling system would be generally similar to the CPL cooling system 14 shown in FIG. 3, with two significant differences. First, the reservoir 93 would be eliminated, and the sensor 94 and heater 96 would interact directly with the liquid return line 89. Second, the evaporators 61-70 would each be replaced with a different type of evaporator, one example of which is shown in FIG. 5.

Figure 5:
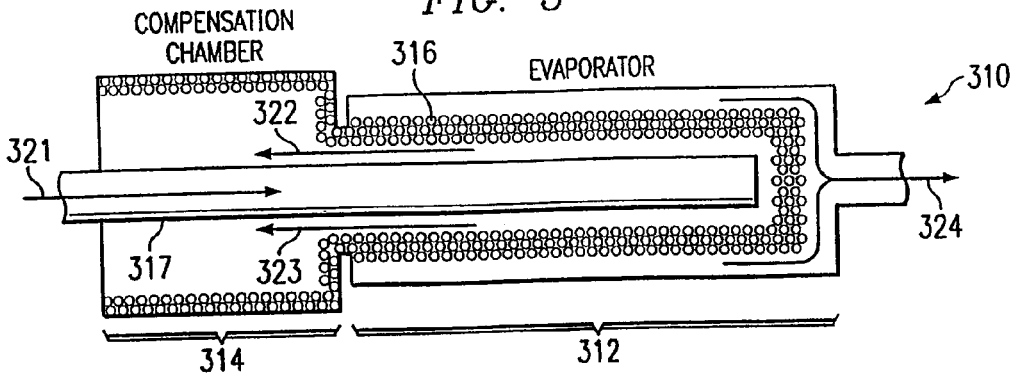
FIG. 5 is a diagrammatic sectional view of an evaporator which is an alternative embodiment of evaporators used in the cooling systems of FIGS. 1 and 3.

More specifically, FIG. 5 is a diagrammatic sectional view of an evaporator 310 which includes an evaporator portion 312 and a compensation chamber 314. The evaporator 310 has a housing with a wick 316 therein. The wick 316 is made from a material of the type discussed above in association with the wick 103 of FIG. 3. The wick 316 extends from the compensation chamber portion 14 into the evaporator portion 312. A recess is provided within the wick 316, and has a greater transverse size in the compensation chamber portion 314 than in the evaporator portion 312. An inlet tube 317 extends through the compensation chamber portion 314 and into the evaporator portion 312, within the recess in the wick 316.

Cooling fluid enters the evaporator 310 through the inlet tube 317, as indicated diagrammatically by an arrow 321. This fluid then enters the wick 316. Some of the fluid exiting the tube 317 flows back along the outside of the tube 317 until it can enter the wick 316. Heat absorbed by the evaporator 310 causes the liquid within the wick 316 to change to a vapor, and to then exit the evaporator 310 through an outlet, as indicated diagrammatically by an arrow 324. Fluid flow through the evaporator 310, and thus around the loop, is effected by capillary pressure within the wick 316, in a manner similar to that discussed above in association with FIGS. 1 and 3.

The present invention provides a number of technical advantages. One such advantage is that use of a cooling system driven by capillary pressure provides sufficient cooling to minimize temperature gradients across an antenna array of a phased array antenna system, while also providing effective control of the temperatures within the array. A related advantage is that these features are achieved without the weight or expense of overlapping sets of heat pipes, or additional electronic circuitry. Another advantage is that, where the cooling system is configured as a capillary pumped loop, a liquid reservoir of the loop provides sufficient fluid inventory to accommodate variable heat generation by the array over time, as well as variable heat generation across the array.

A different advantage results from the provision of a cooling system which has a number of evaporators that effect a flow of cooling fluid through capillary pressure, and which includes a manifold that distributes cooling fluid efficiently to each evaporator. A related advantage is realized where the manifold supplies cooling fluid successively to the evaporators, in an order corresponding to a progressive increase in the amounts of heat dissipated by the evaporators. Another advantage is realized where the manifold effects fluid distribution to successive evaporators through a series of T-junctions which each permit fluid flow into a respective evaporator through a straight first passageway section, while drawing off some fluid for subsequent evaporators through a second passageway section which is generally perpendicular to the first passageway section.

Although selected embodiments have been illustrated and described in detail, it will be understood that various substutions and alterations are possible without departing from the spirit and scope of the present invention, as defined by the following claims.

What is claimed is:

1. An apparatus, comprising:

structure which generates heat; and a cooling section which accepts and dissipates heat generated by said structure, said cooling section including a loop containing a cooling fluid, said loop including a plurality of evaporators disposed in the region of said structure, a manifold section for distributing fluid flowing through said loop among said evaporators, and a plurality of wicks which are each disposed within a respective said evaporator, said wicks effecting a capillary pressure which urges said fluid to travel around said loop, said manifold section distributing the fluid to said evaporators in a sequence corresponding to a progressive increase in the respective amounts of heat accepted by said evaporators from said structure.

2. An apparatus according to claim 1, wherein said manifold section includes a plurality of first passageway sections which each have an inlet end and which each have an outlet end coupled to an input of a respective said evaporator, and includes a plurality of second passageway sections that each have a first end approximately normal to and communicating with a respective said first passageway section, and that each have a second end coupled to said first end of a different said first passageway section.

3. An apparatus according to claim 1, wherein said structure includes an antenna section having a plurality of antenna elements, and having circuitry with a plurality of circuit portions that are each operatively coupled to a respective one of said antenna elements, said circuitry generating said heat which is accepted and dissipated by said cooling section.

4. An apparatus according to claim 3, wherein said antenna section includes a phased array antenna, said antenna elements and said circuitry being portions of said phased array antenna.

5. An apparatus according to claim 4, wherein said antenna elements are arranged in a plurality of rows;

wherein said phased array antenna includes a plurality of parallel slats which each have thereon a plurality of said circuit portions that correspond to said antenna elements in a respective said row; and wherein said evaporators are each disposed adjacent a respective one of said slats.

6. An apparatus according to claim 5, wherein said evaporators are each disposed between and adjacent two of said slats.

7. An apparatus according to claim 4, wherein said antenna elements all lie approximately in a common plane;

wherein said circuitry is provided on a circuit board extending approximately parallel to said plane of said antenna elements; and wherein each said evaporator of said cooling section is disposed adjacent at least a portion of said circuitry.

8. An apparatus according to claim 1, wherein said loop of said cooling system is a capillary pumped loop.

9. An apparatus according to claim 8, wherein said loop of said cooling system includes:

a condenser disposed along said loop at a location remote from said evaporators, said fluid flowing through said evaporators and through said condenser; and a reservoir which is in fluid communication with said loop, and which contains a quantity of said fluid.

10. An apparatus according to claim 9, wherein said cooling system is configured to sub-cool the fluid exiting said condenser; and including a heater for causing the fluid arriving at said evaporators to have approximately a selected temperature.

11. An apparatus according to claim 10, including a sensor for sensing the temperature of the fluid within said reservoir; and wherein heat from said heater is supplied to said fluid in said reservoir.

12. An apparatus according to claim 1, wherein said loop of said cooling system is a loop heat pipe.

13. An apparatus according to claim 12, wherein each said evaporator has a compensation chamber; and wherein said loop includes a condenser disposed along said loop at a location remote from said evaporators, said fluid flowing through said evaporators and through said condenser.

14. An apparatus according to claim 13, wherein said cooling system is configured to sub-cool the fluid exiting said condenser; and including a heater for causing the fluid arriving at said evaporators to have approximately a selected temperature.

15. An apparatus according to claim 1, including a plurality of isolators which are each disposed at an inlet to a respective said evaporator.

16. An apparatus according to claim 1, wherein said loop of said cooling system includes a condenser disposed along said loop at a location remote from said evaporators, said fluid flowing through said evaporators and through said condenser; and including a heat sink which is in thermal communication with said condenser.

17. A method of cooling structure which generates heat, comprising the steps of:

providing in the region of said structure a plurality of evaporators which each include a wick;

utilizing capillary pressure of the fluid within said wicks to urge the fluid to travel around said loop;

distributing fluid flowing through said loop among said evaporators with a manifold section having a plurality of first passageway sections which each have an inlet end and which each have an outlet end coupled to an input of a respective said evaporator, and having a plurality of second passageway sections that each have a first end which is approximately normal to and communicates with a respective said first passageway section, and that each have a second end which is coupled to said first end of a different said first passageway section, wherein said manifold section distributes the fluid to said evaporators in a sequence corresponding to a progressive increase in the respective amounts of heat accepted by said evaporators from said structure.

18. A method according to claim 17, including the step of configuring said manifold section to distribute the fluid to said evaporators in a sequence corresponding to a progressive increase in the respective amounts of heat accepted by said evaporators from said structure.

19. A method according to claim 17, including the step of selecting as said loop a capillary pumped loop.

20. A method according to claim 17, including the step of selecting as said loop a loop heat pipe.

21. A method according to claim 17, wherein said loop includes a condenser disposed along said loop at a location remote from said evaporators, said fluid flowing through said evaporators and through said condenser, and including the steps of:

sub-cooling the fluid exiting said condenser; and heating the fluid in a manner causing the fluid arriving at said evaporators to have approximately a selected temperature.

22. A method of cooling structure which generates heat, comprising the steps of:

providing in the region of said structure a plurality of evaporators which each include a wick;

utilizing capillary pressure of the fluid within said wicks to urge the fluid to travel around said loop;

distributing fluid flowing through said loop among said evaporators in a sequence corresponding to a progressive increase in the respective amounts of heat accepted by said evaporators from said structure.

23. A method according to claim 22, wherein said distributing step is carried out using a manifold section that includes a plurality of first passageway sections which each have an inlet end and which each have an outlet end coupled to an input of a respective said evaporator, and that includes a plurality of second passageway sections, each said second passageway section having a first end approximately normal to and communicating with a respective said first passageway section, and having a second end coupled to said first end of a different said first passageway section.

24. A method according to claim 22, including the step of selecting as said loop a capillary pumped loop.

25. A method according to claim 22, including the step of selecting as said loop a loop heat pipe.

26. A method according to claim 22, wherein said loop includes a condenser disposed along said loop at a location remote from said evaporators, said fluid flowing through said evaporators and through said condenser; and including the steps of:

sub-cooling the fluid exiting said condenser; and heating the fluid in a manner causing the fluid arriving at said evaporators to have approximately a selected temperature.

* * * * *